US012274375B2

(12) United States Patent
De Jong et al.

(10) Patent No.: US 12,274,375 B2
(45) Date of Patent: Apr. 15, 2025

(54) CHILD CARRIER

(71) Applicant: Thule Sweden AB, Hillerstorp (SE)

(72) Inventors: Reinoud De Jong, Gorinchem (SE); Jort Nijhuis, Amsterdam (NL); Mark Thibadeau, Longmont, CO (US); Marleen Offringa, Utrecht (NL); Fortu De Haas, Acquoy (NL); Homero Heredia, Jönköping (SE)

(73) Assignee: Thule Sweden AB, Hillerstorp (SE)

( * ) Notice: Subject to any disclaimer, the term of this patent is extended or adjusted under 35 U.S.C. 154(b) by 71 days.

(21) Appl. No.: 17/362,426

(22) Filed: Jun. 29, 2021

(65) Prior Publication Data

US 2022/0000276 A1 Jan. 6, 2022

(30) Foreign Application Priority Data

Jul. 3, 2020 (EP) ..... 20184003

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC ..... A45F 2004/006; A45F 3/08; A45F 3/10; A47D 13/02; A47D 13/025; A47D 15/006; A47D 13/027; A47D 15/00
USPC ..... 224/158–161
See application file for complete search history.

(56) References Cited

U.S. PATENT DOCUMENTS 5,868,292 A * 2/1999 Stephens ..... A47D 13/025 224/155
6,318,608 B1 * 11/2001 Fowler ..... A47D 13/025 224/159
6,715,651 B2 * 4/2004 Le Gal ..... A47D 13/025 224/160

(Continued)

FOREIGN PATENT DOCUMENTS

DE 202016003651 U1 * 10/2016 ..... A47D 13/025

OTHER PUBLICATIONS https://www.youtube.com/watch?v=V8c45_57mHs, Mar. 9, 2015 (Year: 2015).*

(Continued)

*Primary Examiner* — Nathan J Newhouse
*Assistant Examiner* — Matthew T Theis
(74) *Attorney, Agent, or Firm* — Sterne, Kessler, Goldstein & Fox P.L.L.C.

(57) ABSTRACT

A child carrier with a carrying structure having a front portion and a rear portion. Between the front portion and the rear portion an accommodating space is defined between which a seating unit may be suspended. The seating unit forms a shell-like seat structure. At least one portion of the seat structure is cup-shaped. The seating unit also includes a height-adjustable seat middle portion. The seat middle portion is designed to support a child at a predetermined seat height. The seating unit also includes thigh support portions. The thigh support portions each provide a thigh support surface for a respective thigh of a child. The thigh support portions are coupled to the seat middle portion in such a way that an adjustment of the seat height simultaneously results in an adjustment of the thigh support surface.

26 Claims, 6 Drawing Sheets

(56) References Cited

U.S. PATENT DOCUMENTS

| | | | | |
|---|---|---|---|---|
| 7,152,771 | B2 * | 12/2006 | Le Gal | A45F 3/047 224/636 |
| 2015/0245718 | A1 * | 9/2015 | Lundgren | A45F 3/08 224/161 |

OTHER PUBLICATIONS

DE-202016003651-U1 Translation, Hoppener-Visser M, Oct. 27, 2016 (Year: 2016).*

ThuleBringYourLife, Child carrier backpack—Thule Sapling Elite, dated Mar. 9, 2015, URL:https://www.youtube.com/watch?v=V8c45_57mHs.

European Search Report and Written Opinion for European Patent Application No. 20184003.0, mailed Nov. 2, 2020 (5 pages).

* cited by examiner

CHILD CARRIER

CROSS REFERENCE TO RELATED APPLICATION

This application claims priority to EP Application No. 20184003.0, filed Jul. 3, 2020, which is incorporated herein in its entirety by reference.

TECHNICAL FIELD

The present disclosure relates generally to devices for carrying children. More particularly, the present disclosure relates to back-mounted child carriers.

BACKGROUND

Child carriers have been used for years to carry children in such a way that the wearer has both hands free. Different child carriers are known in the prior art, for example the type used for hiking. Typically, such child carriers have a structure similar to that of a backpack. Instead of a luggage compartment, however, there is a seating arrangement on this backpack in which a child can be seated and carried. Child carriers known from the prior art have the problem, however, that it is difficult to optimally adjust the seating arrangement for children of different sizes.

SUMMARY

There is thus a need for an improved child carrier that addresses the above disadvantages.

According to the present disclosure, a child carrier according to independent claim 1 is provided. Advantageous further formations are subject of the dependent claims.

In addition, other desirable features and characteristics will become apparent from the summary and detailed description, and the appended claims, taken in conjunction with the accompanying drawings.

According to an aspect, a child carrier is provided which can be easily adapted to children of different sizes. The adaptability of the child carrier according to the present disclosure may be such that when a seat height is adjusted, a thigh support portion is also adjusted at the same time. In this way an adjustment of the seat height results in a simultaneous adjustment of a support surface for supporting one of the child's thighs. Thus, when the seat height is adjusted, a further adjustment of the seat to the size of the child is achieved at the same time.

According to a further aspect, a removable seating unit and a child carrier with such a removable seating unit is disclosed. The seating unit may comprise the adaptability to children of different sizes as described before or as described below in greater detail. However, a removable seating unit may not necessarily comprise the adaptability described herein or may only comprise selected features for adapting the seating unit and child carrier to children of different sizes, for example features allowing a height adjustment of the seating unit. For example, the seating unit may be configured without the herein described thigh support portions although other features as described herein may be provided on the seating unit, if desired, in particular features relating to the detachable fixation of the seating unit or features allowing an adjustment of the seat height.

According to another aspect, a side support portion and a child carrier with such a side support portion are disclosed. The side support portion may be configured as described below. The side support portion may be provided on a seating unit which is fixedly mounted in the child carrier or may be provided on the removable seating unit as described herein. At least some features and members of the side support portion may be provided on the seating unit. If such a seating unit is removable, these features and members may also be removed from the child carrier together with the seating unit.

Embodiments of child carriers, seating units and side support portions are described below and may include one or more of the features and characteristics described herein. The embodiments may be suitably combined.

The child carrier may comprise a carrying structure. The carrying structure may have a front portion and a rear portion. Between the front portion and the rear portion an accommodating space may be defined. More precisely, the front portion and the rear portion may limit an accommodating space.

In some embodiments, a seating unit as described herein may be provided and in some embodiments, the child carrier may also comprise such a seating unit. The seating unit may be suspendable or suspended between the front portion and the rear portion. The seating unit may form a shell-like seat structure. At least one portion of the seat structure may be cup-shaped or bucket shaped. The seating unit may also comprise a seat middle portion, preferably a height-adjustable seat middle portion. The seat middle portion may be designed to support a child at a predetermined seat height.

In some embodiments, the seating unit may comprise thigh support portions. The thigh support portions may each provide a thigh support surface for a respective thigh of a child. The thigh support portions may be coupled to the seat middle portion in such a way that an adjustment of the seat height simultaneously results in an adjustment of the thigh support surface. At least the seat middle portion may be made from a flexible and non-elastic material, for example a fabric. In this way, the seat middle portion may be bendable but non-extendible in length.

In some embodiments, the seat middle portion may comprise a rear main seat portion. When the child carrier is in use, i.e. when a child is seated in the child carrier, the rear main seat portion can support most of the child's body weight. In some embodiments, the seat middle portion may further comprise a front secondary seat portion. The front secondary seat portion may extend forward from the rear main seat portion. When using the child carrier, the front secondary seat portion is located between the child's legs. The thigh support portions may be at least partially coupled to the front secondary seat portion.

In some embodiments, the seating unit may comprise a flexible surface structure. The flexible surface structure can define the seat structure. The flexible surface structure may be suspended so that the main seat portion is U-shaped when viewed from the front. Furthermore, the surface structure may be suspended in such a way that, when viewed from the front, the front secondary seat portion can form a W-shape together with the thigh support portions as the front secondary seat portion may be fixed forming a central upper portion of the W-shape and as the thigh support portions may be fixed on opposite sides of the front secondary seat portion forming the outer upper ends of the W-shape. The thigh support portions may define the lower portions of the W-shape thereby forming the recessed portions of the W-shape in which the thigh may be accommodated. Such recessed portions may be referred as leg loops, wrapping portions of the thigh support portions.

Each of the thigh support portions can extend laterally away from opposite portions of the seat middle portion, forming a wrapping portion which may also be referred to as leg loop. Each wrapping portion may at least partially support an outer region of a child's thigh when the child is seated in the child carrier.

At least each thigh support portion of the seating unit may comprise a fabric structure.

Each thigh support portion may comprise a front edge portion facing the front portion of the carrying structure. The front edge portion may at least partially define a front end of the thigh support surface. The front edge portion may at least partially comprise a padding. The front edge portion may comprise a strap extending along the front edge portion. Such a strap may provide a reinforcement.

Each thigh support portion may comprise a first end portion which is attached to the seat middle portion. The first end portion may, for example, be sewn on or may be integrally formed with the seat middle portion. In addition, each thigh support portion may comprise a second end portion attached to the child carrier at an fixation portion remote from the seat middle portion.

In some embodiments, the child carrier may comprise at least one side support portion, preferably two side support portions. Each side support portion protects a child seated in the child carrier from falling out sideways. The above mentioned fixation portion can be provided on one side support portion.

In some embodiments, at least one side support portion can comprise at least one first pivotable member. The first pivotable member may be pivotably held on the front portion of the carrying structure or the rear portion of the carrying structure at its first end portion and may be detachably coupled to the other portion of the front portion or the rear portion at its second end portion in order to at least partially laterally limit the accommodating space. In some embodiments, at least one side support portion may be made of two parts. The two-part side support portion can comprise a second pivotable member which can be connected to the first pivotable member in an overlapping manner. A connection between the second pivotable member and the first pivotable member can be made with a connecting device, such as a buckle. The first pivotable member may comprise a receiving portion, such as in the form of a pocket, for receiving a free end portion of the second pivotable member. The second pivotable member may be stiffer than the first pivotable member.

In some embodiments, each side support portion may comprise at least one fixation member for fixing an accessory, for example a pillow. The at least one fixation member may be provided at an upper portion of the side support portion. For example, the fixation member may comprise a fastening loop.

In some embodiments, a detachable seating unit is provided. The seating unit may be detachably mounted on the carrying structure. In this way it is possible to replace the seating unit if damaged or to remove it from the carrying structure for cleaning purposes.

The seat middle portion may comprise a first fixation portion. The seat middle portion can be detachably coupled to the front portion via the first fixation portion. The first fixation portion preferably comprises a first member of a first positive locking connection. For example, the first member can be a member of a buckle, such as a click or snap buckle.

The seat middle portion may comprise a second fixation portion allowing the seat middle portion to be detachably coupled to the rear portion on the carrying structure. The second fixation portion preferably comprises a first member of a second positive locking connection, for example a member of a piping connection, for example a piping track or piping.

The first member of the second positive connection may comprise a piping and the rear portion may comprise a track for receiving the piping. The track may be accessible via a lateral insertion opening formed in the carrying structure and comprising a dimension which allows the insertion of the first member, for example the piping, transversely to the longitudinal direction of the track, so that the first member can be laterally inserted into the track. The insertion opening may be provided at a predetermined distance from one end of the track. This allows the first member, when inserted into the track, to be at least partially accommodated on opposite sides of the insertion opening in the track so that the piping is prevented from coming loose from the track.

In some embodiments, the front portion of the carrying structure may comprise a height adjustment mechanism. The height adjustment mechanism allows to adjust the fixation height of the first fixation portion between a first height position and a second height position.

The height adjustment mechanism can be configured such that the mounting height of the first fixation portion is steplessly adjustable. The height adjustment mechanism may comprise a closed loop. The closed loop may be guided on an upper guide and a lower guide. The upper guide may comprise a releasable locking arrangement with a self-locking function. The locking of the releasable locking arrangement may be released by an actuation of a user. In particular, the locking arrangement may comprise a release member, for example a lever, which may be actuated by the user to release the locking. The first fixation portion may be detachably coupled to the closed loop. In particular, a coupling member may be permanently attached to the closed loop. The fixation portion may cooperate with the coupling member to be detachably coupled to the coupling member. A padding for covering the height adjustment mechanism, in particular for covering the upper guide including the releasable locking arrangement, may be provided.

In some embodiments, the carrying structure may comprise a rigid frame. Accordingly, the child carrier may be a frame-type child carrier. The frame may be made of aluminum profiles. Alternatively, the frame may be made of profiles made of other lightweight metals or alloys.

Additional features and advantages of the above aspects and embodiments may be gleaned by the person skilled in the art from the following description of exemplary embodiments, which are not to be construed as limiting, however, drawing reference to the attached drawings.

BRIEF DESCRIPTION OF THE DRAWINGS

The present disclosure will hereinafter be described in conjunction with the following drawing figures, wherein like numerals denote like elements.

All figures are only schematic depictions of exemplary embodiments in which, in particular, distances and dimensional correlations are not presented to scale.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
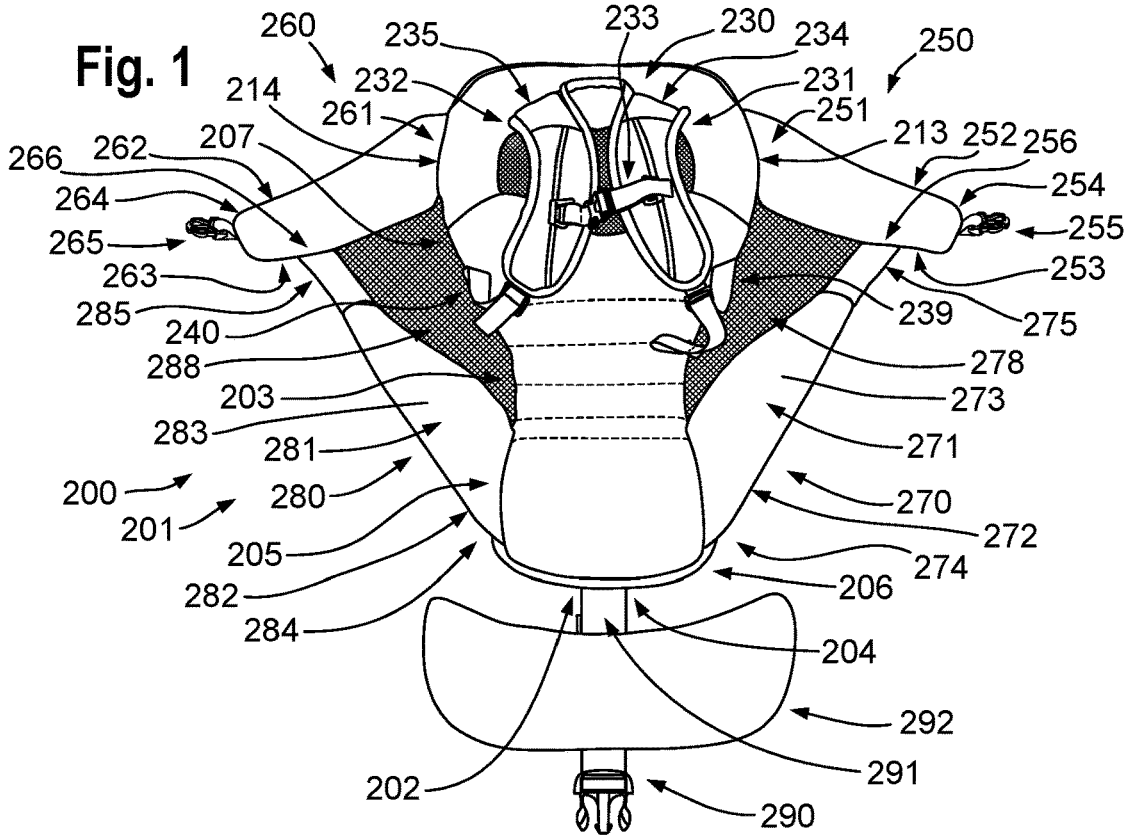
FIG. 1 shows a front view of a seating unit according to an embodiment.
Figure 2:
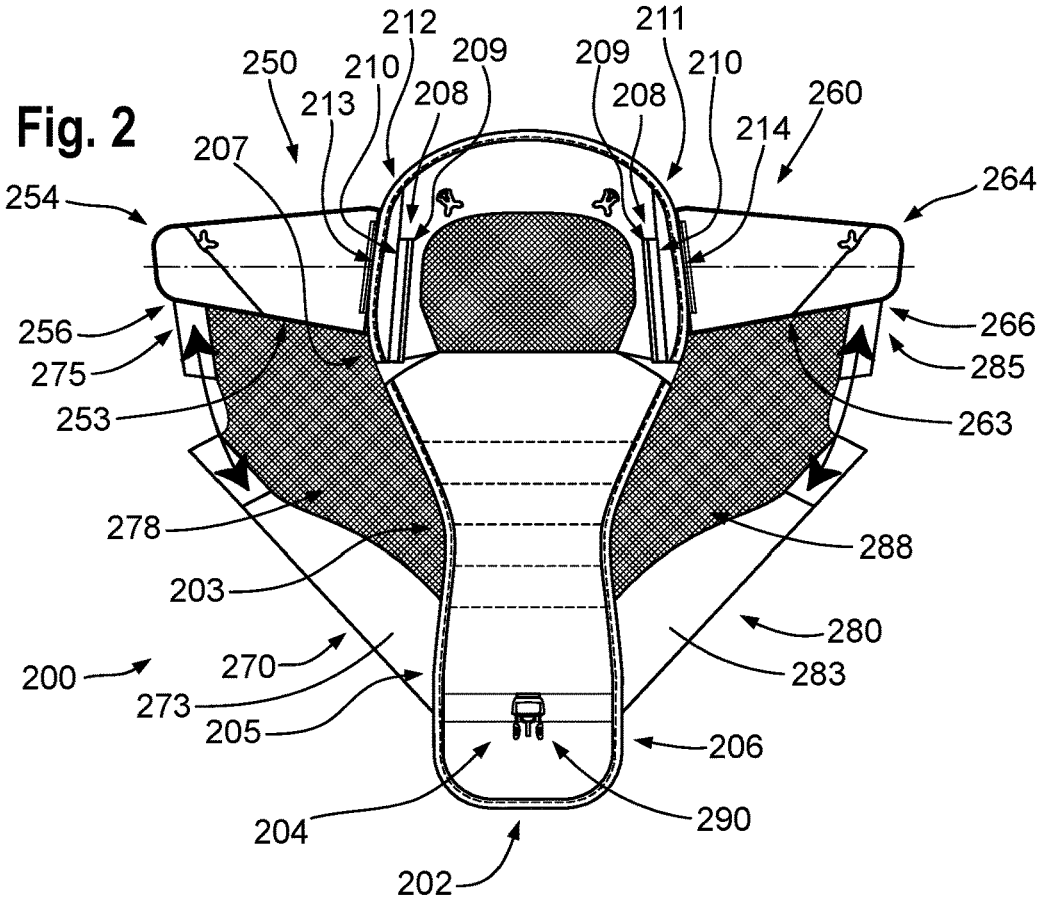
FIG. 2 shows a rear view of the seating unit shown in FIG. 1.

FIG. 1 shows a front view of a seating unit 200 according to an embodiment. FIG. 1 shows the seating unit 200 positioned on a flat surface. In particular, FIG. 1 shows an inner side of seating unit 200. FIG. 2 shows a rear view of seating unit 200 according to the embodiment, positioned flat on a flat surface. In particular, FIG. 2 shows an outer side of the seating unit 200. The seating unit 200 may comprise a flexible surface structure 201 defining the seating unit.

The seating unit 200 comprises a seat middle portion 202. The seat middle portion 202 may comprise a rear main seat portion 203 and a front secondary seat portion 205. In addition, the seat middle portion 202 may comprise a back support portion 207, which may also be referred to as backrest portion. The seat middle portion 202 may be made form a flexible and non-elastic material, allowing it to bend but substantially preventing any length change of the seat middle portion. The transitions between the rear main seat portion 203 and the front secondary portion 205 may be seamless or may be provided by way of a seam.

The main seat portion 203 may, according to one embodiment, the portion which bears most of the child's body weight when using the seating unit 200, meaning when a child is seated in the seating unit 200. The main seat portion 203 can therefore also be referred to as bottom support portion, as it is designed primarily to support the child's bottom.

The front secondary seat portion 205 may extend forward from the rear main seat portion 203. The front secondary seat portion 205 may therefore be located in front of the rear main seat portion 203. The front secondary seat portion 205 may be located between the child's legs when using the seating unit 200. The main seat portion 203 and the secondary seat portion 205 can together form a saddle-like seat structure.

The back support portion 207 may be provided on a side of the main seat portion 203 opposite the side where the front secondary seat portion 205 extends from the main seat portion 203. Thus the seat middle portion 202 may be formed by the back support portion 207, the main seat portion 203 and the secondary seat portion 205 in this order in forward direction. The back support portion 207 comprises a strap assembly 230 which serves for securing the child in the seating unit 200.

The strap assembly 230 may comprise two shoulder straps 231, 232 which can be coupled together by means of a two-part chest strap 233. The shoulder straps 231, 232 can be detachably attached to the back support portion 207. The shoulder straps 231, 232 may each comprise an upper end portion 234, 235 which can be detachably attached to the back support portion 207. For example, each upper end portion 234, 235 may be coupled to the back support portion 207 by means of a buckle connection 236, 238 (see FIGS. 7 and 8). The buckle connections 236, 238 may be provided so that they are accessible from above to disconnect the upper end portions 234, 235 from the back support portion 207. In particular, the buckle connections 236, 238 may be located behind a seat cushion portion 237 and thus, for example, be hidden or provided on the outside of the back support portion 207. In addition, each of the shoulder straps 231, 232 may comprise a lower end portion 239, 240 which can also be detachably attached to the back support portion 207. The lower end portions 239, 240 may be coupled to the back support portion 207 in a similar manner as the upper end portions 234, 235, for example with a buckle connection (not shown). The shoulder straps 231, 232 can be adjustable in length to adapt the shoulder straps 231, 232 to a child's size.

Figure 3:
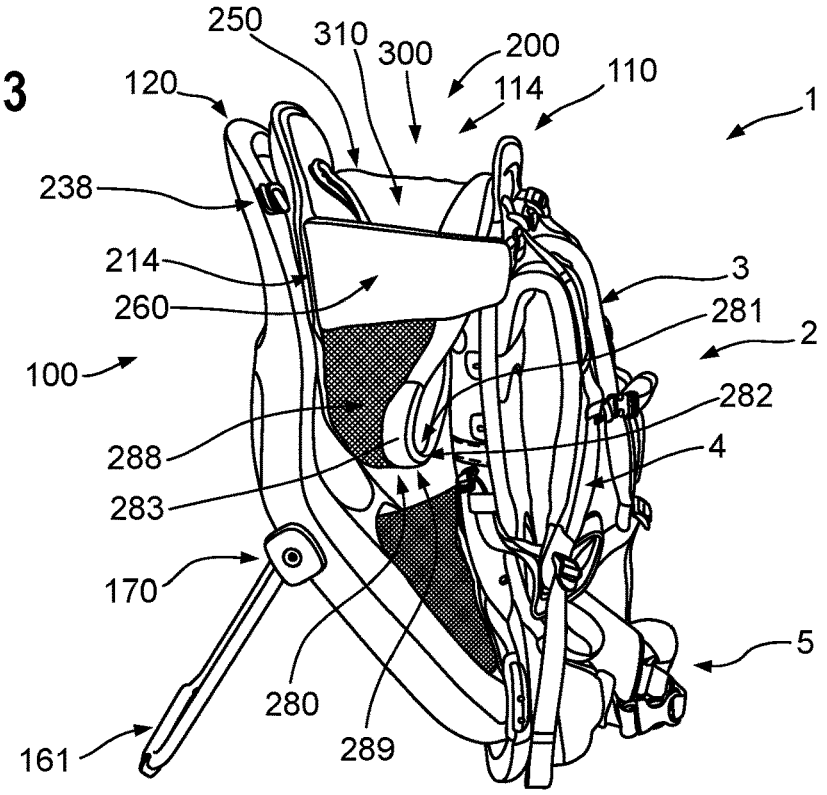
FIG. 3 shows a perspective view of a child carrier according to an embodiment.

A fixation portion 204 may be provided at the front secondary seat portion 205, more precisely at its front end portion 206, which may also be referred to as forward longitudinal end portion. More precisely, the fixation portion 204 is provided on the outer side of the secondary seat portion 205. According to the present embodiment, the fixation portion 204 may be provided for detachably attaching the seat middle portion 202 to a front portion 110 of a carrying structure 100 of a child carrier 1 as shown in FIG. 3 and indicated in FIG. 6. The carrying structure 100 and the child carrier 1 will be described later in greater detail. In the present embodiment, the fixation portion 204 may comprise a coupling member 290 which is exemplary shown as a male part of a buckle arrangement. The coupling member 290 may comprise two lateral latching portions and can be releasably locked into a coupling member 101, for example a receiving portion embodied as a female part of the buckle arrangement, provided on the carrying structure 100. The coupling member 290 may be provided on the fixation portion by means of a strap 291. A padded member 292 may be provided on the strap to provide a soft chest support for the child.

Two fixation portions 208 are provided on the back support portion 207 in order to detachably fix the back support portion 207 and thus the seat middle portion 202 to a rear portion 120 of the carrying structure 100 of the child carrier 1. Each of the two fixation portions 208 may comprise one member of a piping connection. In the embodiment shown, the two fixation portions 208 each comprise a piping 209, which can be inserted through an opening 104 into a track 102 provided on the carrying structure 100 (see FIG. 9). The piping 209 comprises a piping flap 210 which, in the embodiment shown, is attached, for example sewn, to an outside of the back support portion 207. The two fixation portions 208 are each located at a lateral end portion 211, 212 of the back support portion 207.

Figure 9:
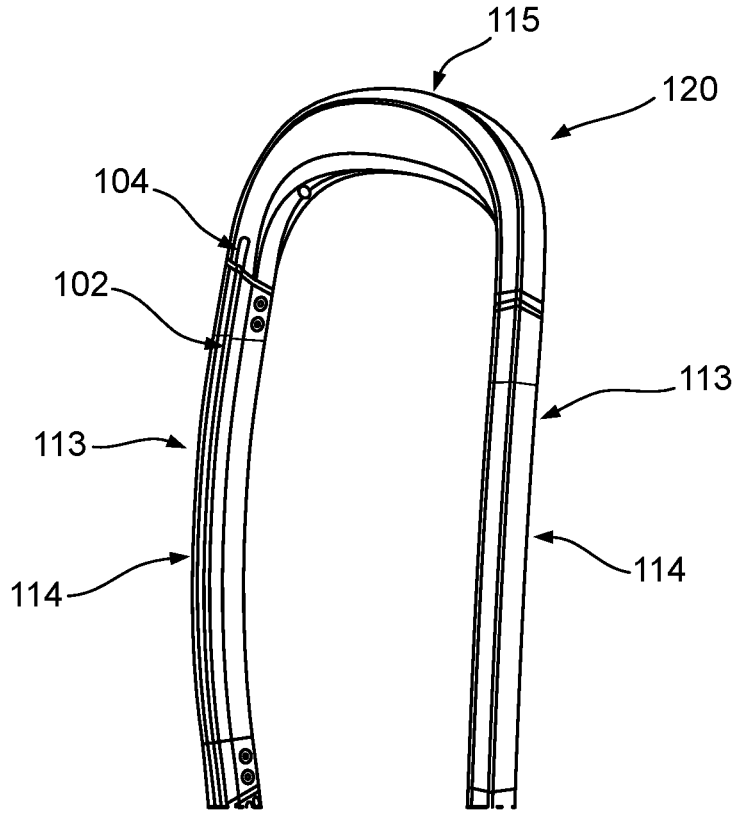
FIG. 9 schematically shows a rear portion of the carrying structure according to an embodiment.
Figure 11:
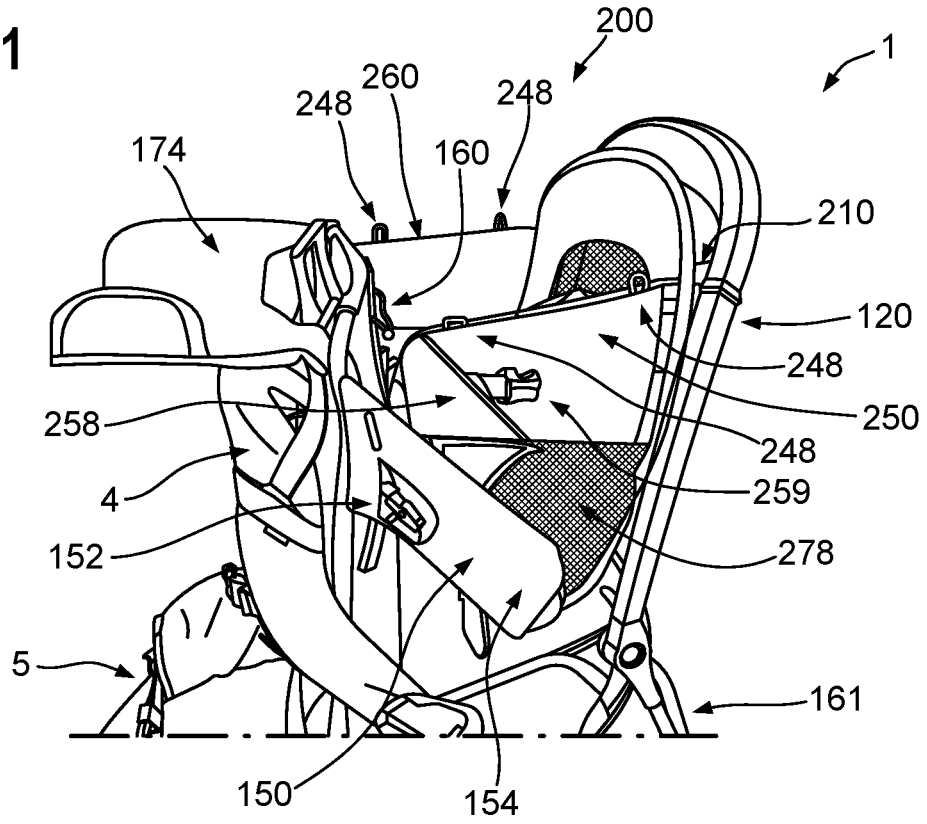
FIG. 11 shows a perspective view of a child carrier according to another embodiment.

As shown in FIG. 2, piping 209 may extend along a respective lateral edge portion 213, 214. In the embodiment shown, piping 209 may be configured to extend in a substantially vertical direction when inserted into the respective track 102 on the carrying structure 100. As shown in FIG. 9, the rear portion 120 of the carrying structure 100 can be formed from profiles 113, for example aluminum profiles. The rear portion 120 of the carrying structure 100 may be in the form of an inverted U with two leg portions 114 extending downwardly from a common bridging portion 115 at the top of the rear portion 120. A track 102 may be formed in each leg portion. The track 102 is formed by a recess or groove which extends in the longitudinal direction of the leg portions and defines an accommodating space in which the aforementioned piping 209 is receivable and comprises a slot portion which is narrower than the accommodating space and is adapted to receive the aforementioned piping flap 210. FIG. 11 shows an embodiment in which the seating unit 200 is arranged in the carrying structure 100. The piping 209 is inserted into the rear portion 120 and the piping flap 210 coupling the back support portion 207 to the rear member 120 is visible.

Figure 10:
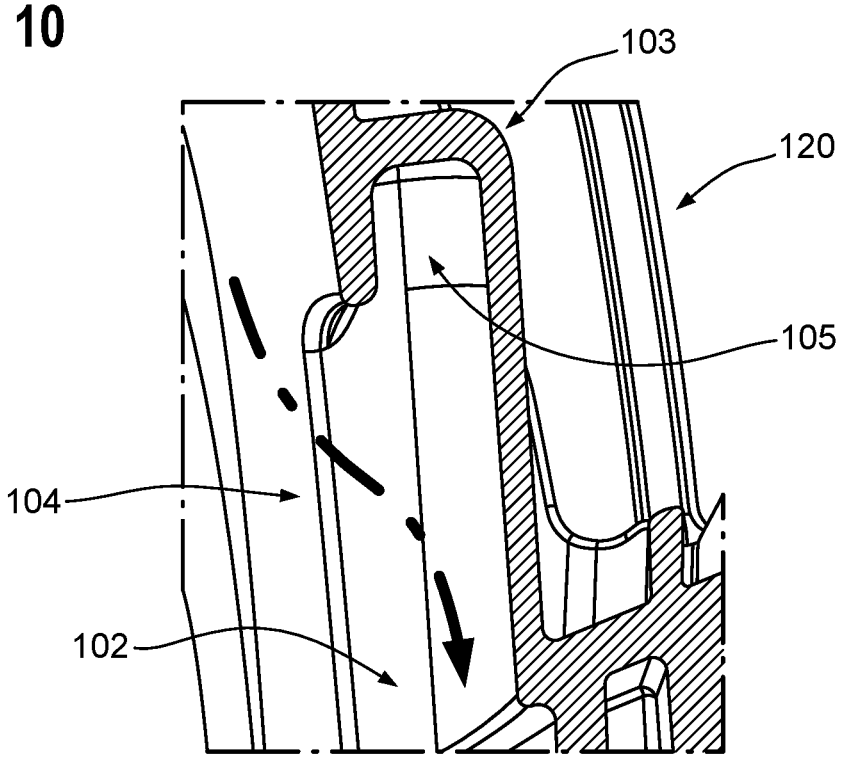
FIG. 10 shows an enlarged sectional view of the rear portion of the carrying structure in the region of an insertion opening.

To enable the piping 209 to be inserted laterally into the accommodating space, an insertion opening 104 is formed in a predetermined area of the slot portion, as shown for example in FIG. 9. In the embodiment as shown in FIG. 10, the insertion opening 104 can be located at a predetermined distance from one end of the track 102, so that when the piping 209 is inserted in the track 102, the piping 209 can be at least partially received in the track 102 on opposite sides of the insertion opening 104, so that the piping 209 is prevented from leaving the track 102 on its own through the insertion opening 104. This is prevented by a dead hole 105 which is formed in the end portion 103 of the track 102 and into which an end portion of the piping 209 can slide when the piping 209 is moved upwards.

Thus, according to the present embodiment, a seating unit 200 is provided, which can be detachably fastened to the carrying structure 100 by means of the fixation portion 204 and the fixation portions 208 in a suspended manner.

Furthermore, the seating unit 200 can comprise two side support members 250, 260, which at least partially form a side support portion 300, 310 of the child carrier 1 as exemplary shown in FIG. 3. In the embodiment shown, each side support member 250, 260 is pivotably attached to the back support portion 207 at its first end portion 251, 261. More precisely, in the embodiment shown, the first end portion 251, 261 of each side support component 250, 260 is pivotally coupled to one of the lateral edge portions 213, 214. Each side support member 250, 260 can also be referred to as a side wing, since these side support members 250, 260 extend away from lateral edge portions 213, 214 in a wing type manner. Accordingly, each side support member 250, 260 may be pivoted about the lateral edge portions 213, 214 in order to allow a user to seat a child in the seating unit 200. In other words, a lateral opening may be created by pivoting one of the side support members 250, 260 outwards.

Figure 12:
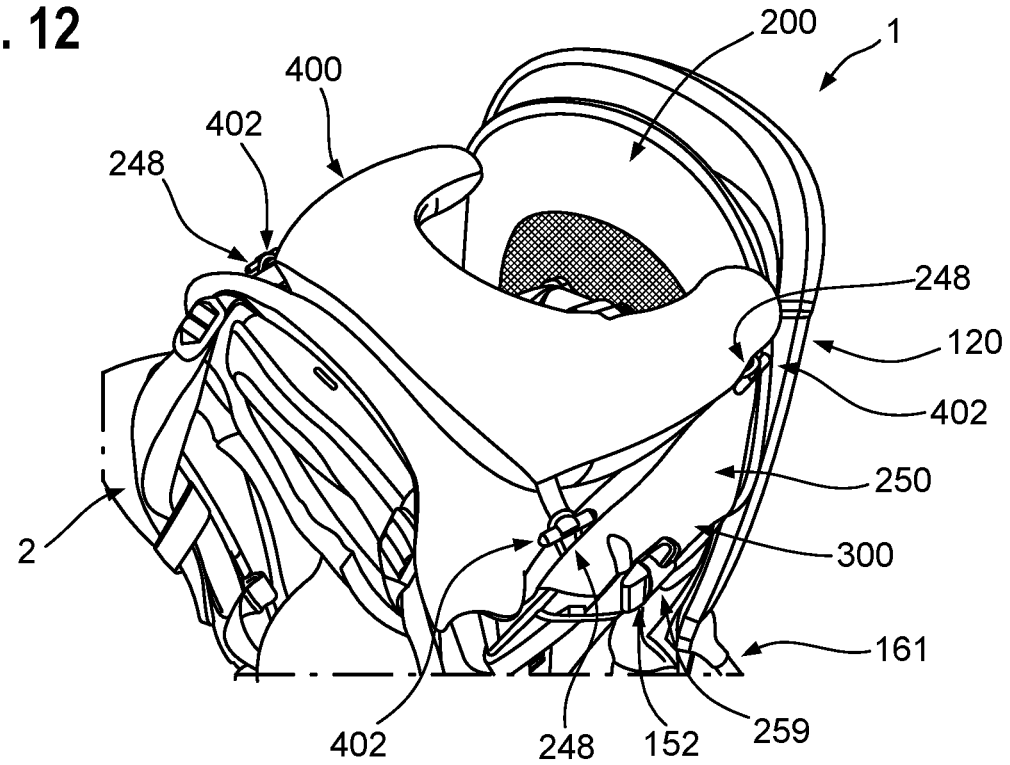
FIG. 12 shows a perspective view of a child carrier according to another embodiment.

Each side support member 250, 260 may comprise an upper portion 252, 262 and a lower portion 253, 263. Although not shown in FIGS. 1 and 2, a fixation member 248 may be provided at the upper portions 252, 262 for the attachment of an accessory 400 as shown, for example, in FIGS. 7, 8, 11 and 12. In the embodiment shown, the fixation member 248 is designed as a fixation loop. Hook members 402 of the accessory 400 can be hooked into the fixation loops to attach the accessory 400 to the fixation members 248. Such an accessory 400 is shown in FIG. 12 in the form of a cushion which is U-shaped and when mounted extends from a side support member 250 over the front portion 110 of the carrying structure 100 onto the second side support member to cover the respective upper edge portions of the side support portions 300, 310 and the front portion 110.

As is shown in FIG. 11, the side support portions 300, 310 may alternatively each comprise two side support members 250, 150 pivotably arranged such that they may overlap each other. The side support member 250 may be configured as described before. In addition, the side support member 150 may be pivotably coupled to the front portion 110 so that it may be pivoted so as to extend towards the rear portion 120 or such that its free end portion 154 is arranged closest to the rear portion 120. The side support member 250 may comprise a receiving portion 258, for example a pocket, for accommodating the free end portion 154 therein. The side support member 150 may comprise a higher rigidity than the side support member 250 in order to provide increased stiffness. The side support member 250 may comprise a padding on its inner side increasing the child's comfort. The side support member 250 may comprise a coupling member 259 which is engageable with a coupling member 152 provided on the side support member 150 as soon as the end portion 154 is inserted in the pocket 258. In this way, an openable and closable side support portion may be provided.

The seating unit 200 may further comprise two thigh support portions 270, 280. The thigh support portions 270, 280 may comprise thigh support surfaces 271, 281 oriented upwards. Each of the thigh support portions 270, 280 may extend laterally away from opposite portions of the seat middle portion 202. In use, the thigh support portions may form wrapping portions 279, 289 or leg loops configured to at least partially surround the thigh of a child. Each thigh support portion 270, 280 may comprise a first end portion 274, 284 which is attached to the seat middle portion 202. In the embodiment as shown, the first end portions 274, 284 are firmly attached to the seat middle portion 202. However, it is also possible to attach the first end portions 274, 284 detachably to the seat middle portion 202, for example by means of a Velcro fastener or a buckle arrangement.

Each thigh support portion 270, 280 may comprise a second end portion 275, 285 which is attached to a fixation portion 256, 266 remote from the seat middle portion 202. In the embodiment shown, the fixation portion 256, 266 is provided at the lower portions 253, 263 of the side support members 250, 260. In other words, in the embodiment shown, the second end portions 275, 285 are attached to the lower portions 253, 263 of the side support members 250, 260. A front end of the fixation portion 256, 266 may be provided in the area of a front end portion 254, 264 of the side support members 250, 260. Coupling members 255, 265 may be provided on the front end portion 254, 264 and may be configured to directly or indirectly couple the side support members 250, 260 to the front portion 110, for example via a coupling member 183 provided on the front portion 110 (see FIG. 4). For example, the coupling members 255, 265 may comprise an element of a coupling arrangement, for example one of two mating members of a magnetic connection (see FIG. 4), a hook and loop connection, or a buckle connection. If the coupling members 255, 265 are coupled to the front portion 110, the side support portions 300, 310 are active and able to prevent a child from laterally falling out of the child carrier 1. On the other hand, if the coupling members 255, 265 are decoupled, the support members 250, 260 may be pivoted outwards to render the inner space of the seat accessible.

Figure 4:
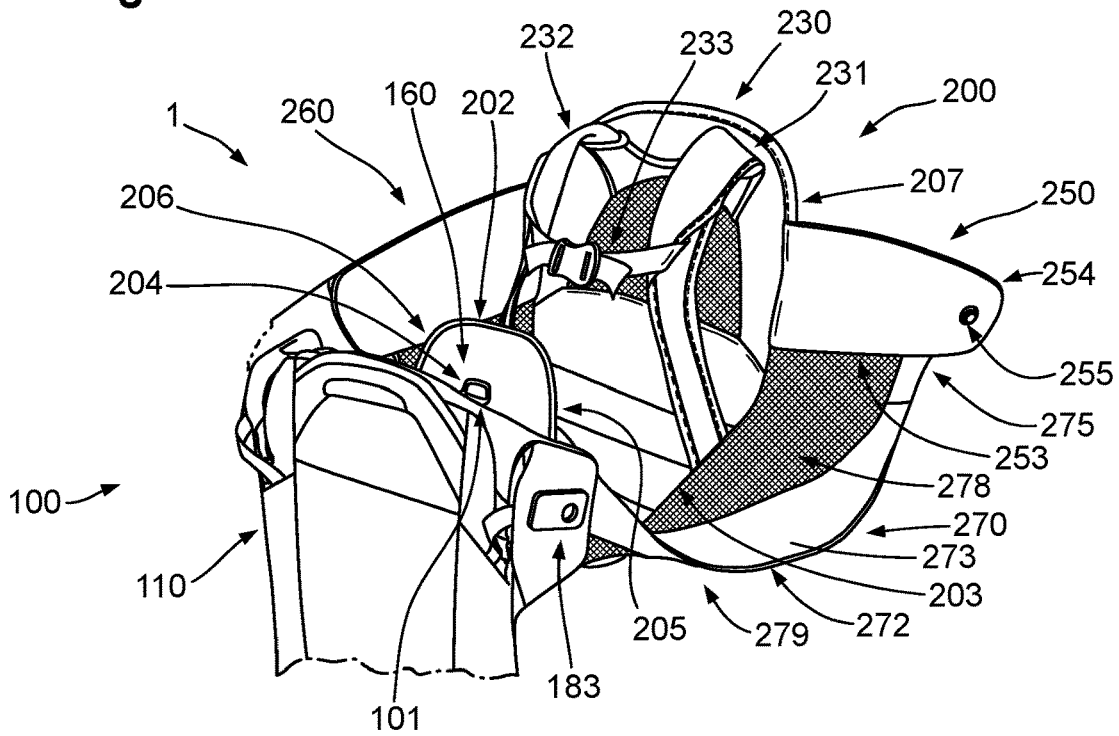
FIG. 4 shows an upper part of the child carrier shown in FIG. 3.

Each thigh support portion 270, 280 comprises a front edge portion 272, 282 which faces the front portion 110 of the carrying structure 100. The front edge portion 272, 282 may at least partially define a front edge portion of the thigh support surface 271, 281. Each front edge portion 272, 282 may comprise a padded portion 273, 283. The padded portions 273, 283 may improve the seating comfort of the child. The padded portions 273, 283 may extend from the seat middle portion 202 towards the side support members 250, 260. The front edge portion 272, 282 may extend inclined with respect to the longitudinal direction of the seat middle portion 202 as is shown in FIGS. 1 and 2, in particular inclined with respect to a vertical longitudinal middle plane, and may at least partially protrude substantially straight from the seat middle portion when placed on a plane as shown in FIGS. 1 and 2. In this way, the thigh support portions 270, 280 may form the above mentioned wrapping portions 279, 289 when the seating unit 200 is mounted to the carrying structure 100 in a suspended manner as shown in FIGS. 3 and 4.

The front edge portion 272, 282 according to the exemplary configuration extends from the seat middle portion 202, more precisely form the front secondary seat portion 205, up to the side support members 250, 260, for example to the lower portions 253, 263 of the side support members 250, 260, in particular at a front end portion 254, 264 of the side support members 250, 260. The front edge portion 272, 282 may comprise the padded portion 273, 283 as described before. Thus, the front edge portion 272, 282 may comprise a predetermined width and thus provide at least a portion of the thigh support surfaces 271, 281. A fabric structure 278, 288, for example a net or mesh structure, may be arranged between the front edge portion 272, 282, the lower portion 253, 263 and a lateral portion of the seat middle portion 202. Depending on the size of the front edge portion 272, 282, the fabric structure 278, 288 may be omitted such that an opening is present between the latter mentioned parts instead of the fabric structure. It is noted that the thigh support portions 270, 280 may be provided by means of a flexible surface structure, for example a fabric. Furthermore, the seat middle portion 202 and the thigh support portions 270, 280 may be formed from a flexible surface structure and may according to a modification be formed from a single flexible surface structure. In other words, the seat middle portion 202 and the thigh support portions 270, 280 may be integrally formed. However, the seat middle portion 202 may also be formed from a different material with different characteristics.

FIG. 3 shows a perspective view of the child carrier 1 with a carrying structure 100 and with a seating unit 200 attached to the carrying structure 100. FIG. 4 shows a perspective view of the child carrier 1 shown in FIG. 3 from obliquely above and in an open position in which a child can be seated in the seating unit 200. In both Figures, it is visible that the seating unit 200 defines a cup-like or shell-like structure when it is mounted on the carrying structure 100. The seat middle portion 202 as well as the thigh support portions 270, 280 define a bag shaped interior space in which the child may be seated.

The carrying structure comprises the front portion 110 and the rear portion 120. Furthermore, the child carrier 1 comprises a harness structure 2 with two shoulder straps 3, 4 as well as a hip belt 5. The harness structure is coupled to the front portion 110 and allows a user to carry the child carrier 1 on the back. A ground support 161 is coupled to the rear portion 120 by means of a pivot 170. The ground support 161 is pivotable between a use position, in which it is deployed and provides additional ground support portions for the child carrier 1 and a non-use position in which the ground support 161 is in a retracted position. Furthermore, FIG. 3 shows the child carrier 1 in a use state in which the side support members 250, 260 are coupled to the front portion 110 and thereby provide side support portions 300, 310. Since the thigh support portions 270, 280 are coupled to a lower portion of the side support members at one end and coupled to the seat middle portion 202 at the other end, wrapping portions 279, 280 are formed to support the thigh of a child. The wrapping portions provide thigh supporting surfaces 271, 281.

Figure 6:
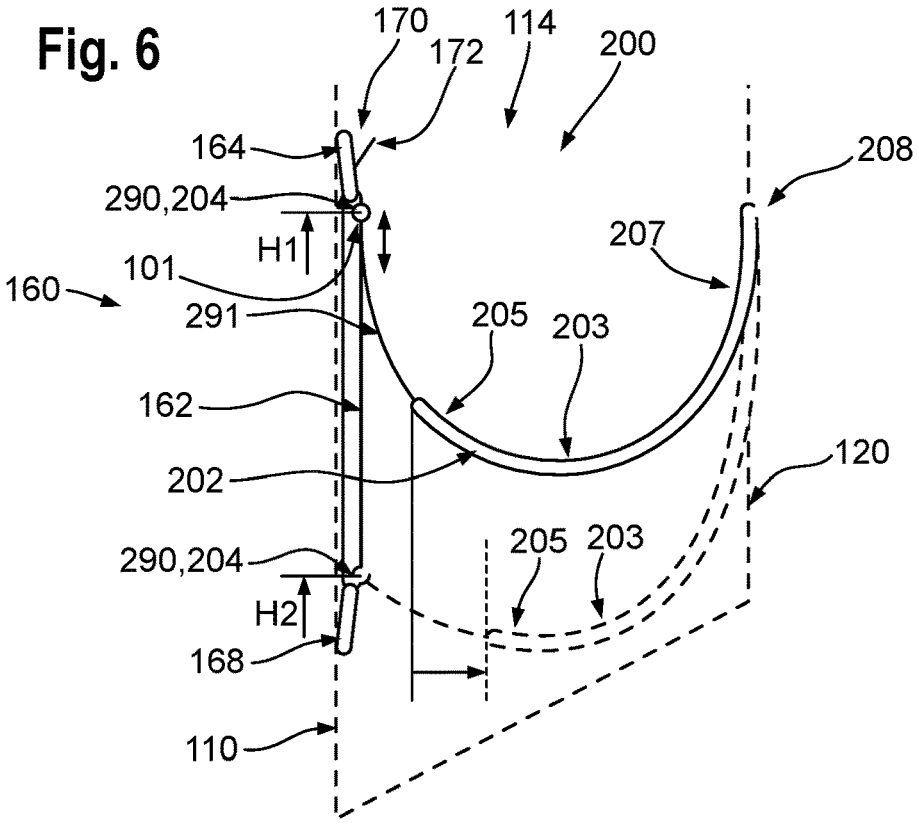
FIG. 6 schematically shows a possible type of suspension of the seating unit on the carrying structure.

The seating unit 200 is height adjustable. FIG. 6 shows a schematic illustration of how the seating unit 200 is suspended in the carrying structure 100 and may be adjusted. More precisely, it is shown how the seat middle portion 202 is height-adjustable suspended between the front portion 110 and the rear portion 120. A height adjustment mechanism 160 is arranged on the front portion 110. The height adjustment mechanism 160 may allow to adjust the attachment height of the first fixation portion 204 between a first height position H1 and a second height position H2. The height adjustment mechanism 160 may comprise an upper guide 164 and a lower guide 168. A closed loop 162 is movably spanned between the upper guide 164 and the lower guide 166 such that it extends substantially in vertical direction. The upper guide 164 may comprise a releasable locking arrangement 170 having a self-locking function and the locking of the releasable locking arrangement 170 may be releasable by actuating a release member 172, for example a lever. As is shown in FIG. 11, a padded portion 174 for covering the height adjustment mechanism, in particular for covering the upper guide including the releasable locking arrangement, may be provided. In FIG. 11, the padded portion 174 is hingedly held on the front portion 110 and shown in a state in which it is folded outward in order to allow a user to access the height adjustment mechanism 160. However, the height adjustment mechanism 160 may also be accessible from above without having to remove or pivot the padded portion 174 away. In FIG. 4, the height adjustment mechanism is accessible from above. Instead of the padded portion 174, the above-mentioned padded member 292 may be provided on the strap for covering the height adjustment mechanism or at least parts thereof.

The front end of the seat middle section 202 is coupled to the loop portion provided on the side of the rear portion 120. For example, the coupling member 290 as described before may be coupled to the loop portion. Thus, by moving the loop, the height position of the coupling member 290 may be changed.

Figure 7:
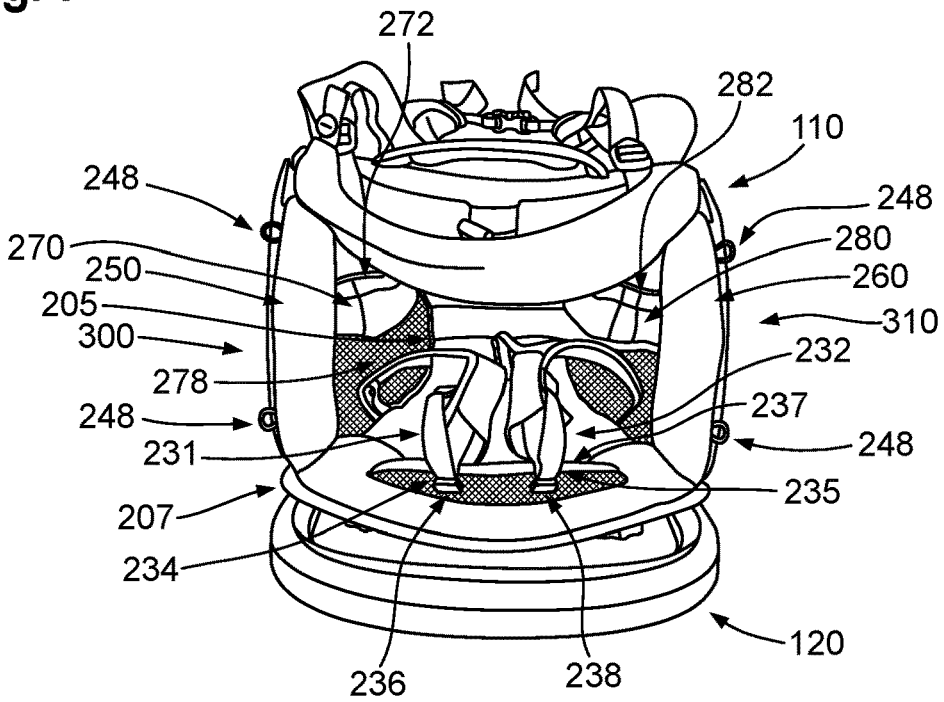
FIG. 7 shows a view of the child carrier from above, the child carrier comprising a setting for a small child.
Figure 8:
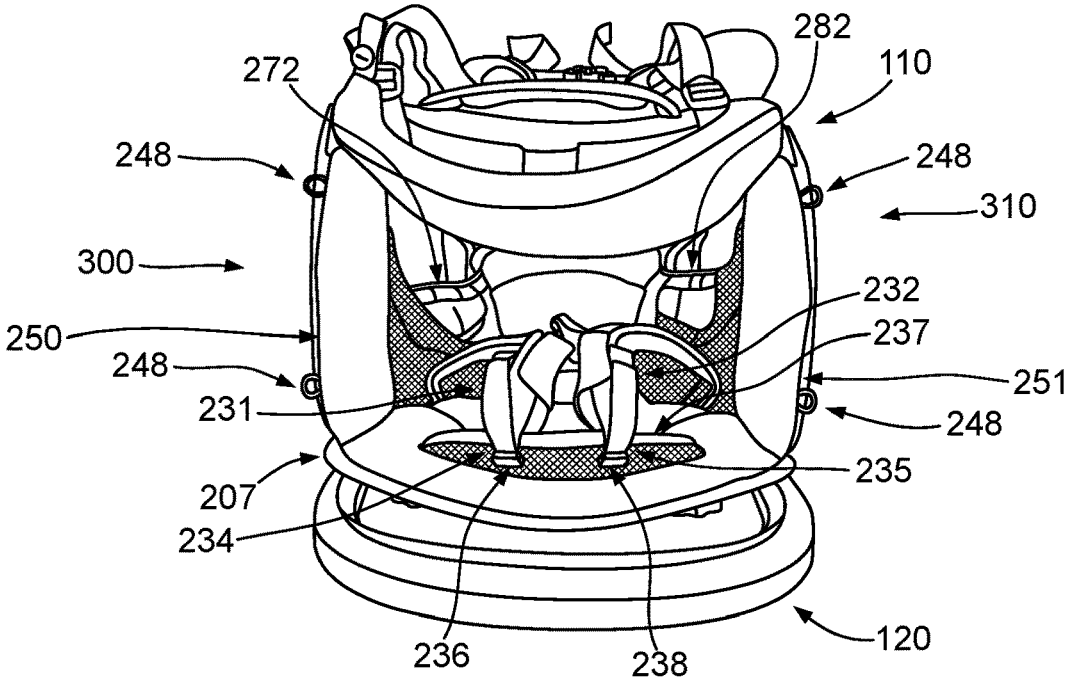
FIG. 8 shows a view of the child carrier from above, the child carrier comprising a setting for a large child.

Such a change of the position of the coupling member 290 in vertical direction results in a change of height of the secondary seat portion 205 and the main seat portion 203. The seat middle portion 202 is thus slightly unwound on one side. This not only results in the above mentioned change in height of the main seat portion 203 and the secondary seat portion 205 but also results in a horizontal position change of these portions since the seating unit 200 is fixedly held on the rear portion 120 by means of the second fixation portion 208. Therefore, lowering the coupling member 290 thus results in a position change of the secondary seat portion 205 towards the rear portion 120. Since the thigh support portions 270, 280 are laterally coupled to the seat main portion 202 as described before, the front edge portions 272, 282 are also moved towards the rear portion 120 so that the distance between the front edge portions 272, 282 and the front portion 110 is increased. In this way, the size and location of the thigh support surfaces 271, 281 is also changed. The latter adjustment as is described in connection with FIG. 6 is also clearly visible from FIGS. 7 and 8. FIGS. 7 and 8 show top views of the child carrier 1 according to the embodiment. FIG. 7 shows a state in which the child carrier 1 is configured for carrying a small child. FIG. 8 shows a state in which the child carrier 1 is configured for carrying a large child. As is directly visible, the front edge portions 272, 282 of the thigh support portions 270, 280 are moved backwards towards the rear portion 120 in the state of FIG. 8 and are moved forward towards the front portion 110 in the state of FIG. 7. In this way, available thigh supporting surfaces are changed. In FIG. 7, the seating unit 200 is configured to provide a higher support compared to the configuration shown in FIG. 8. Therefore, the front edge portions 272, 282 are arranged closer to the front portion 110 in the state according to FIG. 7 and are arranged at a greater distance from the front portion 110 in the state according to FIG. 8.

Figure 5:
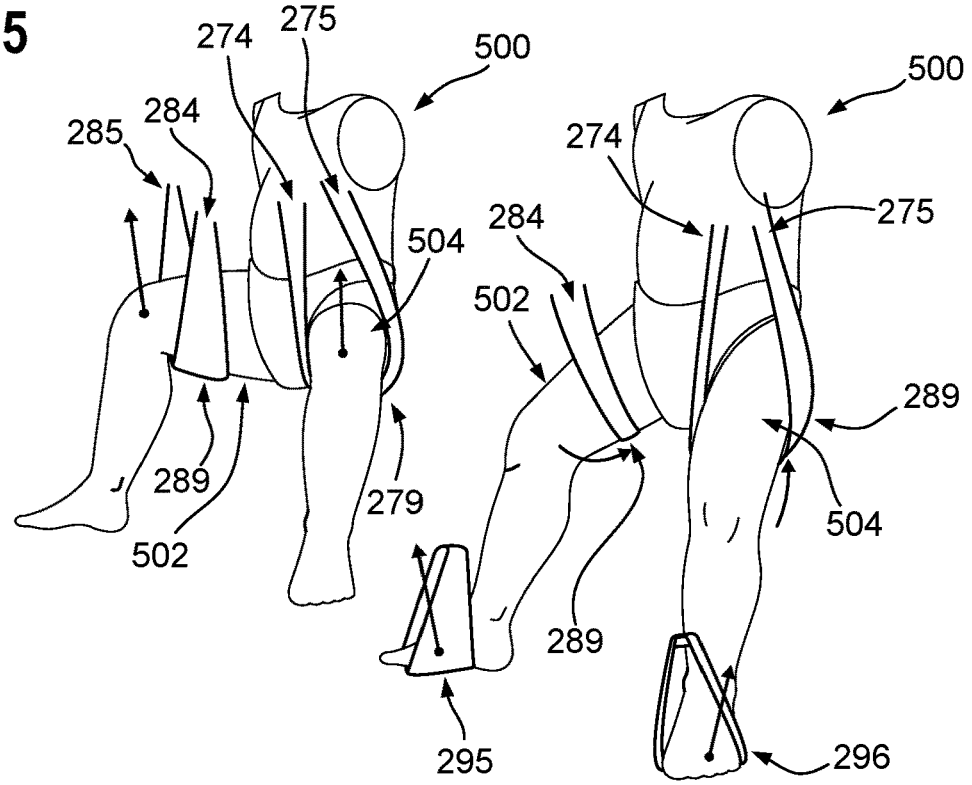
FIG. 5 shows the support function principle according to the present disclosure.

The functional principle of the present disclosure may also be gleaned from the illustration according to FIG. 5 in which on the left hand side it is shown how a smaller sized child 500 may be supported by the seating unit 200 and on the right hand side it is shown how a larger child 500 may be supported by the seating unit 200. It may be desirable to support a small child near the knee thus supporting substantially the entire or at least a knee end portion of its thighs 502, 504 from below and to support at least the bottom of the child. In this way, an ergonomic support of the child is possible even allowing to hold the child in the so called frog style according to which the thighs 502, 504 are angled more than 90 degrees. By moving the first fixation portion 204 upwards, the front edge portions 272, 282 of the thigh support portions 270, 280 are raised, for example above a position at which the seat main portion 203 is arranged and closer to the front portion 110. Accordingly, a thigh support surface of increased size is provided allowing to support the child's thigh near the knee. The wrapping portions 279, 289 extend close to the knee. On the contrary, if the first fixation portion 204 is moved downwards, the front edge portions 272, 282 of the thigh support portions 270, 280 are lowered for example such that the front edge portions 272, 282 are lowered to a position at which the seat main portion 203 is arranged or to a lower position. This results in smaller sized thigh support surfaces which only support a portion of the child's thigh, for example less than half of the length of the child's thigh. This allows to carry the child in riding style. In some configurations, footrest portions 295, 296 may be provided on laterally outer ends of the front portion 110 for supporting the child's feet.

In summary, a child carrier is configurable in a plurality of different configurations, for example with a seating unit that may be removable and/or which is height adjustable and/or which may comprise thigh support portions. In particular, a seating unit comprising only one of the latter characteristics may be provided. For example, a removable seating unit comprising some of the above features regarding removability may be provided. Furthermore, the carrier may comprise at least one of the side support portions as described before in combination with a seating unit as disclosed herein. However, the side support portions may also be used on child carriers with any other seating unit. Examples of some exemplary configurations are provided below in addition to the configurations as presented in the appended claims. These exemplary configurations may be supplemented by or combined with features and characteristics as described before and/or as described in the appended claims.

A first exemplary configuration of a child carrier 1 may comprise a carrying structure 100 and a seating unit 200, wherein the seating unit 200 is detachably mounted on the carrying structure 100. The carrying structure may comprise a front portion 110 and a rear portion 120 defining a receiving space 114 therebetween, and the seating unit 200 may be suspendable between the front portion 110 and the rear portion 120 under formation of a shell-like seat structure. For that, the seating unit 200 may comprise a first fixation portion 204 at a forward end portion thereof and a second fixation portion 208 at a rear portion thereof. The first fixation portion 204 may be releasably coupled to the front portion 110 by means of a first positive connection or positive locking connection. The second fixation portion 204 may be releasably coupled to the rear portion 120 by means of a second positive connection or positive locking connection. A positive locking connection may be provided in different ways. For example, a piping connection may be used. The seating unit may be optionally structured as described herein by way of the embodiments and may thus optionally comprise thigh support portions, for instance.

A second basic configuration of a child carrier 1 may comprising a carrying structure 100, a seating unit 200 and at least one side support portions 300, 310 which protects a child sitting in the child carrier 1 from falling out sideways. The at least one side support portion 300, 310 may be formed in two parts, a first side support portion and a second side support portion, fixable to each other in an overlapping manner. One of the two parts may be directly or indirectly pivotably coupled to the front portion of the carrying structure and the other one of the two parts may be directly or indirectly pivotably coupled to the rear portion of the carrying structure. For example, at least one of the two parts may be directly coupled to the seating unit. One of the two parts may comprise a receiving portion, for example a pocket, for receiving a free end portion of the other one of the two parts. One of the two parts may be stiffer than the other one or may generally comprise an increased stiffness in order to increase the overall rigidity of a side support portion. The two parts may be coupled by a connecting arrangement as described in the exemplary embodiments herein. The seating unit may be optionally structured as described herein by way of the embodiments and may thus optionally comprise thigh support portions, for instance.

In conclusion a, it is pointed out that the terms like "comprising" or the like are not intended to rule out the provision of additional elements or steps. Let it further be noted that "a" or "an" do not preclude a plurality. In addition, features described in conjunction with the different embodiments can be combined with each other however desired. It is also noted that the reference numbers in the claims are not to be construed as limiting the scope of the claims. Moreover, while at least one exemplary embodiment has been presented in the foregoing summary and detailed description, it should be appreciated that a vast number of variations exist.

It should also be appreciated that the exemplary embodiment or exemplary embodiments are only examples, and are not intended to limit the scope, applicability, or configuration in any way. Rather, the foregoing summary and detailed description will provide those skilled in the art with a convenient roadmap for implementing an exemplary embodiment, it being understood that various changes may be made in the function and arrangement of elements described in an exemplary embodiment without departing from the scope as set forth in the appended claims and their legal equivalents.

What is claimed is:

1. A child carrier comprising:

a carrying structure having a front portion and a rear portion defining a receiving space therebetween; and a seating unit suspended between said front portion and said rear portion, wherein said seating unit comprises a height-adjustable seat middle portion adapted to support a child at a predetermined seat height, wherein said seat middle portion comprises first and second edge portions, wherein said seating unit comprises first and second thigh support portions each providing a respective thigh support surface for supporting a respective thigh of a child by wrapping around a bottom of the respective thigh of the child at a knee end portion of the respective thigh of the child, wherein each of said first and second thigh support portions comprise respective inner and outer edge portions, wherein each of said first and second thigh support portions are coupled to said seat middle portion such that an adjustment of said seat height simultaneously results in an adjustment of said respective thigh support surface of each of said first and second thigh support portions, wherein said inner edge portion of said first thigh support portion is spaced from said first edge portion of said seat middle portion, and wherein said inner edge portion of said second thigh support portion is spaced from said second edge portion of said seat middle portion.

2. The child carrier according to claim 1, wherein said seat middle portion comprises a rear main seat portion against which, in use, most of the body weight of the child rests, a front secondary seat portion extending forwardly from said rear main seat portion which, in use, is located between the legs of the child, and wherein said first and second thigh support portions are at least partially coupled to said front secondary seat portion.

3. The child carrier according to claim 2, wherein said seating unit comprises a flexible surface structure defining the seat structure, wherein said surface structure is suspended such that, when viewed from the front, the main seat portion is U-shaped and the front secondary seat portion can form a W-shape together with each of said first and second thigh support portions.

4. The child carrier according to claim 1, wherein said first and second thigh support portions extend laterally away from opposite portions of said seat middle portion thereby forming respective wrapping portions, each of said wrapping portions at least partially supporting an outer region of the respective thigh of the child when the child is seated in the child carrier.

5. The child carrier according to claim 1, wherein at least each of said first and second thigh support portions comprise a fabric structure, wherein a first mesh structure is disposed between said inner edge portion of said first thigh support portion and said first edge portion of said middle seat portion, and wherein a second mesh structure is disposed between said inner edge portion of said second thigh support portion and said second edge portion of said middle seat portion.

6. The child carrier according to claim 1, wherein each of said respective outer edge portions of said first and second thigh support portions face said front portion and at least partially define a front end of said respective thigh support surface of each of said first and second thigh support portions.

7. The child carrier according to claim 1, each of said first and second thigh support portions comprising a first end portion fixed to said seat middle portion and a second end portion fixed to said child carrier at a fixation portion located remote from said seat middle portion.

8. The child carrier according to claim 7, further comprising two side support portions which protect a child sitting in the child carrier from falling out sideways.

9. The child carrier according to claim 8, wherein at least one side support portion comprises at least one first pivotable side support member which is pivotably held at its first end portion at the front portion or the rear portion and which is detachably coupled to the other portion of the front portion or the rear portion at its second end portion in order to at least partially limit the receiving space laterally, wherein at least one side support portion is formed in two parts.

10. The child carrier according to claim 9, wherein said at least one side support portion comprises a second pivotable side support member that can be connected with said first pivotable side support member in an overlapping manner.

11. The child carrier according to claim 9, wherein said first pivotable side support member comprises a receiving portion for receiving a free end portion of said second pivotable side support member, and wherein said second pivotable side support member is configured to be stiffer than said first pivotable side support member.

12. The child carrier according to claim 11, wherein said side support portion comprises at least one fixation member for fastening an accessory.

13. The child carrier according to claim 1, wherein the seating unit is detachably mounted on said carrying structure.

14. The child carrier according to claim 13, wherein the seat middle portion comprises a first fixation portion for detachably coupling the seat middle portion to the front portion.

15. The child carrier according to claim 14, wherein the front portion comprises a height adjustment mechanism which allows to adjust the attachment height of the first fixation portion between a first height position and a second height position.

16. The child carrier according to claim 15, wherein said height adjustment mechanism is adapted to steplessly adjust the attachment height of said first fixation portion.

17. The child carrier according to claim 16, wherein said height adjustment mechanism comprises a closed loop guided on an upper guide and a lower guide, wherein said upper guide comprises a releasable locking arrangement having a self-locking function and said locking of said releasable locking arrangement is releasable by actuating a release member, wherein said first fixation portion is detachably coupled to said closed loop.

18. The child carrier according to claim 13, wherein the seat middle portion comprises a second fixation portion by means of which the seat middle portion is detachably coupled to the rear portion.

19. The child carrier according to claim 18, wherein said second fixation portion comprises a first member of a second positive-locking connection, wherein said first member of said second positive-locking connection comprises a piping and said rear portion comprises a track for receiving said piping, wherein said track is accessible via a lateral insertion opening which is formed in the carrying structure and has a dimension that permits the insertion of said first member transversely to the longitudinal extension direction of said track, so that said first member can be inserted laterally into said track, wherein said insertion opening can be provided at a predetermined distance from an end of said track so that when said first member is inserted into said track, said first member can be at least partially received in said track on opposite sides of said insertion opening so that said piping is prevented from coming loose from said track.

20. The child carrier according to claim 1, wherein said carrying structure comprises a rigid frame.

21. A child carrier comprising:

a carrying structure having a front portion and a rear portion defining a receiving space therebetween;

a seating unit suspended between said front portion and said rear portion; and a first side support portion extending between said front portion and said rear portion on a first side of the child carrier, and a second side support portion extending between said front portion and said rear portion on a second side of the child carrier opposite the first side of the child carrier, wherein said seating unit comprises a height-adjustable seat middle portion adapted to support a child at a predetermined seat height, wherein said seating unit comprises two thigh support portions, each providing a thigh support surface for supporting a respective thigh of a child, and wherein each thigh support portion extends from a front portion of the seat middle portion to a front portion of a respective side support portion.

22. The child carrier according to claim 21, wherein, in use, the front portions of the side support portions are located in front of the child.

23. The child carrier according to claim 21, wherein each thigh support portion forms a loop.

24. A child carrier comprising:

a carrying structure having a front portion and a rear portion defining a receiving space for a child therebetween; and a seating unit suspended between said front portion and said rear portion, wherein said seating unit comprises:

a height-adjustable seat middle portion comprising a main seat portion which, in use, supports a bottom of the child, and two thigh support portions each providing a thigh support surface configured to support a respective thigh of the child, wherein each thigh support portion comprises an inner edge portion and an outer edge portion and is configured to form a wrapping portion which, in use, at least partially surrounds the respective thigh of the child, wherein each thigh support portion comprises a first end coupled to said seat middle portion, wherein said inner edge portion of each thigh support surface is spaced from the main seat portion, wherein said seat middle portion is adjustable between a first height position and a second height position, and wherein the first end of each thigh support portion is positioned closer to the front portion of the carrying structure in the first height position than in the second height position, thereby positioning a thigh support surface of the thigh support portion closer to a knee of the child in the first height position than in the second height position.

25. The child carrier of claim 24, wherein said second height position is lower than the first height position.

26. The child carrier of claim 24, wherein, in said first height position, front edge portions of said thigh support surfaces are disposed above said main seat portion, and wherein, in said second height position, said front edge portions of said thigh support surfaces are disposed at or below said main seat portion.

* * * * *